United States Patent [19]

Mattoon

[11] 4,187,765

[45] Feb. 12, 1980

[54] APPARATUS FOR PUMPING FLUID FROM A WELL

[76] Inventor: Roland W. Mattoon, P.O. Box 1302, Drayton Valley, Alberta, Canada

[21] Appl. No.: 865,466

[22] Filed: Dec. 29, 1977

[30] Foreign Application Priority Data

Feb. 21, 1977 [CA] Canada ..... 272181

[51] Int. Cl.[2] ..... F04B 1/06

[52] U.S. Cl. ..... 92/13.1; 417/545

[58] Field of Search ..... 74/586; 92/13; 417/554, 417/545

[56] References Cited

U.S. PATENT DOCUMENTS

| | | | |
|---|---|---|---|
| 2,259,020 | 10/1941 | Windman | 74/586 |
| 3,051,237 | 8/1962 | Giles, Jr. et al. | 92/13 |
| 3,251,310 | 5/1966 | Wittwer et al. | 74/586 |
| 3,367,279 | 2/1968 | Crowe | 417/554 |
| 3,376,826 | 4/1968 | Crowe | 417/554 |
| 3,782,123 | 1/1974 | Muschalek | 92/13 |

*Primary Examiner*—William L. Freeh

*Attorney, Agent, or Firm*—Beveridge, DeGrandi, Kline & Lunsford

[57] ABSTRACT

A device for use in well pumping apparatus of the type having a bottom hole pump actuated by a vertically reciprocating operating rod, and in which the pump is of the kind in which a tendency to gas lock can be corrected by extending the downstroke of the pump plunger until this taps on the bottom pump parts. The device of this invention is capable of variably limiting the downstroke of the operating rod to allow the pump to be tapped on the downstroke or to be lifted clear of the bottom, as required. The device includes a cylinder carried by the pump bridle and arranged to be supplied with hydraulic fluid, a piston in the cylinder arranged to be lifted when fluid is pumped into the cylinder, means for holding the piston in its raised position relative to the cylinder, and means on the piston for engaging with a member fixed to the operating rod to raise and lower this relative to the pump bridle.

5 Claims, 2 Drawing Figures

APPARATUS FOR PUMPING FLUID FROM A WELL

The present invention relates to apparatus for correcting gas lock in a bottom hole pump of the type used in oil wells.

In producing oil wells it is common practice to provide a pump at the bottom of the well bore. The pump is actuated by a reciprocating operating rod the top portion of which is a polished rod extending up to the actuating mechanism for the rod at the surface.

A problem with such pumps is that of gas lock. During the suction stroke of the pump, gas may come out of solution and expand, displacing the liquid in the pump and reducing the amount of liquid pumped.

It has been found that the gas lock problem may be corrected with suitable pumps, by lowering the downstroke of the pump plunger until this reaches the bottom of its operating range, thus allowing the travelling valve of the pump plunger to come very close to the standing valve at the bottom of the pump body, thus greatly reducing the gas space. In fact, the plunger may be tapped against the bottom pump parts. However, once the pump has tapped for a few minutes it must be lifted to prevent damage. The present invention provides a device suitable for lowering the downstroke of the pump rod for this purpose.

In accordance with one aspect of the invention, apparatus for pumping fluid from a well includes a bottom hole pump actuated by a vertically reciprocating operating rod, in which the pump is of the kind in which a tendency to gas lock may be corrected by extending the downstroke of the pump plunger, and a device for varying the downstroke of the operating rod. The device is carried by the pump bridle and has a part engageable with a member fixed to said operating rod, and is adjustable in height to vary the operating position of the rod relative to the pump bridle.

The part engageable with said member may be the piston of a cylinder arranged to be supplied with hydraulic fluid, and having means for holding the piston in raised position relative to the cylinder. The latter means may be valve or like means for maintaining fluid pressure within the cylinder, or may be a mechanical connection.

Figure 1:
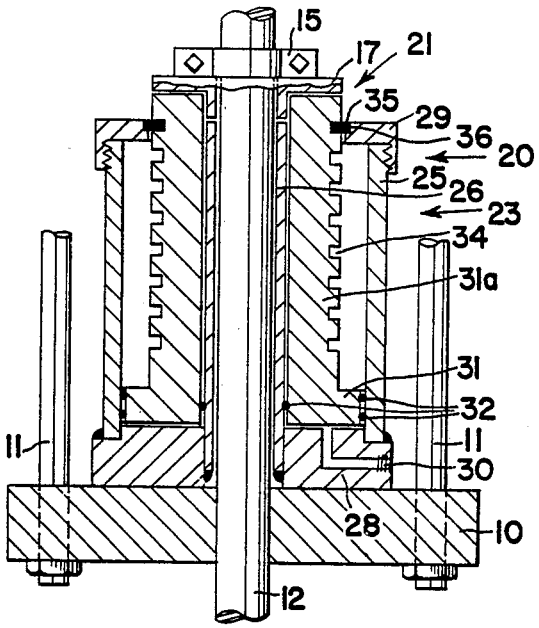
Figure 2:
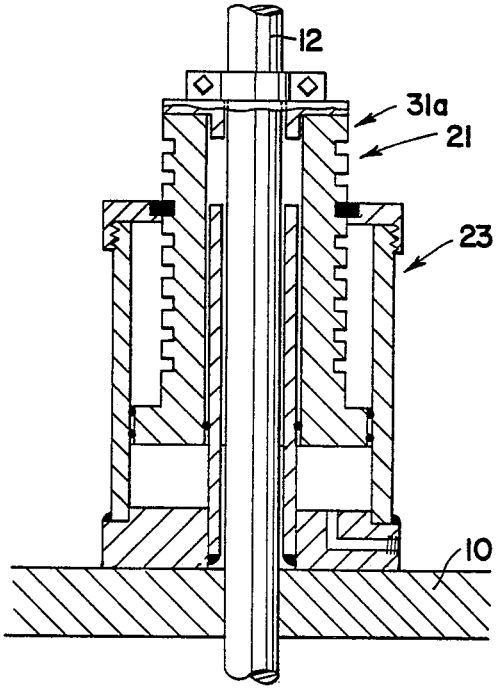

A preferred embodiment of this invention will be described with reference to the accompanying drawings, in which:

FIG. 1 shows a partially sectioned view of a hydraulic device for varying the downstroke of a pump rod, and FIG. 2 shows a similar view of the same device with parts in different positions.

In the drawings, 10 is the bridle of a surface pumping unit having support rods 11, this unit being of known kind for causing vertical reciprocation of an operating rod string terminating at the top in a polished rod 12, the pumping unit and bridle 10 having a fixed stroke. The lower end of the rod string is connected to a pump (not shown) at the bottom of the drill hole, the pump being of the kind in which tendency to gas lock can be corrected by lowering the downstroke of the pump plunger. The pump preferably has a plunger with travelling valve movable within a pump casing at the bottom of the well and in which the travelling valve of the plunger can be brought quite close to the standing valve at the bottom of the casing so that little fluid remains therebetween, allowing the pump plunger to come into contact with liquid above the standing valve. For best results, the pump may be allowed to tap by lowering the downstroke so that the plunger taps against the structure holding the standing valve at the bottom of the pump casing.

The polished rod 12 has fixed to it a clamp 15, which rests on the top of an annular clamp plate 17 which is also movable with the rod. The clamp plate 17 normally rests on the upper end of a part of device 21 which is a central part of this invention. This is in the form of a hydraulic lifter for varying the downstroke of the rod 12 by varying the distance between bridle 10 and the clamp 15.

The device 21 includes a vertical hydraulic cylinder 23 of annular form having outer and inner cylindrical walls 25 and 26 respectively, and annular bottom and top plates 28 and 29 respectively. The inner wall 26, which is welded to the central bore of the bottom plate 28, surrounds the polished rod 12 fairly closely but allows free movement of the rod. The bottom plate 28 has a port 30 to which can be connected a hydraulic fluid line, the port 30 communicating via a passage way with the interior of the cylinder. Part 30 has a valve to hold fluid within the cylinder except when draining is required.

The cylinder contains an annular piston 31 having sealing rings 32 which are movable in sealing relationship with the outer and inner cylinder walls. The piston 31 also has an extension 31*a* which is stepped inwardly from the outer diameter of the piston, having the same inner diameter as the piston, and extending upwardly a length similar to the interior length of the cylinder so that when the piston is close to the bottom of the cylinder, as illustrated in FIG. 1, the top of the extension 31*a*, is adjacent to and preferably above the top plate 29. The piston extension 31*a* has a series of equally spaced grooves 34 along its length, which serve as detents for receiving a locking ring 35 which is a split ring selectively engageable in any of the grooves. The top plate 29 of the cylinder has a small recess 36 which receives the outer portion of the locking ring 35 when this is in place in one of the grooves 34.

Normal operation of the pumping apparatus will be carried out with the locking ring 35 in one of the central grooves of the piston extension, for example in the position which is shown in FIG. 2. If it is required to lower the downstroke of the pump plunger so that this taps against the bottom structure, to release a gas lock, then hydraulic fluid is pumped into the cylinder via the port 30, by means of a hand pump. This raises the piston and extension 31*a* sufficiently to allow the locking ring 35 to be removed from the groove of the piston extension. The hydraulic fluid is then allowed to drain from the cylinder, and the piston falls until a suitable position is achieved (for example the position shown in FIG. 1) where the pump plunger can tap against the bottom of the pump structure.

Once the pump has been tapped for a few minutes and has resumed pumping of liquid, the plunger must be lifted off the bottom of the pump to prevent damage. For this purpose, hydraulic fluid is again pumped into the cylinder via the port 30 causing the piston 31 to rise again to a position slightly higher than that shown in FIG. 2. In this position, the split ring 35 can be repositioned in the requisite groove, as shown in FIG. 2, and the piston can then be allowed to fall until the ring 35 is trapped within the recess 36. The lifting device then remains in this position, preventing the pump from tapping.

The locking ring 35 is useful for ensuring that the piston remains in raised position, in view of possible leakage from the valve connected to port 30.

Although a hydraulic lifting device has been described, the invention is not, in its broadest aspects, limited to a hydraulic lifting device since other mechanisms may be used for the same purpose.

I claim:

1. A device for varying the downstroke of the operating rod of a bottom hole pump, comprising:

a normally vertical hydraulic cylinder of annular form having outer and inner cylindrical walls and annular top and bottom plates, said inner wall being adapted to surround the said pump operating rod, said cylinder having an inlet for hydraulic fluid at its lower end, and being suitable for being carried by the operating mechanism of said pump, an annular piston movable in said cylinder in sealing engagement with the outer and inner walls, said piston including an extension of such length as to be adjacent or above the top of said cylinder when the lower end of the piston is at the bottom of the cylinder, said extension having a series of detents in the outer surface thereof selectively engageable by holding means, which holding means are also engageable with the top plate of the cylinder to hold the piston in a selected raised position, said piston carrying means engageable with said operating rod to vary the downstroke thereof.

2. Apparatus according to claim 1, wherein said detents are grooves surrounding said piston extension, and wherein said holding means is a split ring engageable in said grooves.

3. A device according to claim 1 further comprising a clamp fixable to said operating rod, and a clamp plate positioned between the piston and the clamp.

4. A device for varying the downstroke of the operating rod of a bottom hole pump, including a cylinder arranged to be supplied with hydraulic fluid, a piston in said cylinder arranged to be lifted when the fluid is pumped into said cylinder, said piston having an upwards extension provided with a series of grooves, means for holding said piston in a raised position, said means including a split locking ring selectively engageable in said grooves, said piston having means engageable with a member fixed to said operating rod to vary the downstroke thereof.

5. A device according to claim 4, further comprising a clamp fixable to said operating rod, and a clamp plate positioned between the piston and the clamp

* * * * *